US012631001B2

(12) United States Patent
Kobayashi et al.

(10) Patent No.: US 12,631,001 B2
(45) Date of Patent: May 19, 2026

(54) WORKING VEHICLE

(71) Applicant: TAKEUCHI MFG. CO., LTD., Nagano (JP)

(72) Inventors: Yuta Kobayashi, Nagano (JP); Shumpei Okutani, Nagano (JP); Kengo Kumeuchi, Nagano (JP)

(73) Assignee: TAKEUCHI MFG. CO., LTD., Hanishina-gun (JP)

( * ) Notice: Subject to any disclaimer, the term of this patent is extended or adjusted under 35 U.S.C. 154(b) by 274 days.

(21) Appl. No.: 18/376,039

(22) Filed: Oct. 3, 2023

(65) Prior Publication Data

US 2024/0301654 A1 Sep. 12, 2024

(30) Foreign Application Priority Data

Mar. 8, 2023 (JP) ..... 2023-035260

(51) Int. Cl.
*E02F 9/12* (2006.01)
*E02F 9/08* (2006.01)

(52) U.S. Cl.
CPC ..... *E02F 9/123* (2013.01); *E02F 9/0866* (2013.01)

(58) Field of Classification Search
CPC ..... E02F 9/123; E02F 9/0866; E02F 9/2058; E02F 9/207; E02F 9/2239; E02F 9/2246; E02F 9/2292; F15B 21/045; F15B 21/087
See application file for complete search history.

(56) References Cited

U.S. PATENT DOCUMENTS 6,989,640 B2 * 1/2006 Yoshimatsu ..... E02F 9/2292 318/140
12,043,984 B2 * 7/2024 Choi ..... E02F 9/268
2025/0012050 A1 * 1/2025 Sai ..... F15B 19/00

FOREIGN PATENT DOCUMENTS

EP 3489424 A1 * 5/2019 ..... F15B 11/17
JP 2003-155760 A 5/2003
JP 2006-205777 A 8/2006
JP 2011190072 A * 9/2011
JP 2018-150728 A 9/2018
JP 6463537 B1 2/2019
JP 2022-107122 A 7/2022

OTHER PUBLICATIONS

Office Action dated Jul. 2, 2024, issued in counterpart JP Application No. 2023-035260, with English translation. (10 pages).
Office Action dated Feb. 6, 2024, issued in counterpart JP application No. 2023-035260, with English translation. (7 pages).

* cited by examiner

*Primary Examiner* — Steve Clemmons
(74) *Attorney, Agent, or Firm* — WHDA, LLP

(57) ABSTRACT

A working vehicle includes a control valve unit, a first drive unit, a travel unit, a lower body, an upper body, a second drive unit, a cab, a plurality of work units and a plurality of traveling hydraulic motors, an operation unit, and a controller. The first drive unit includes a first hydraulic pump, a first electric motor. The controller performs a control of the first electric motor and the second electric motor to adjust a first rotation speed of the first electric motor and a second rotation speed of the second electric motor such that a total rotation speed of the first rotation speed and the second rotation speed matches a target rotation speed calculated from required amount of pressure oil.

9 Claims, 7 Drawing Sheets

WORKING VEHICLE

CROSS-REFERENCE TO RELATED APPLICATION

This application is based upon and claims the benefit of priority of the prior Japanese Patent Application No. P2023-035260, filed on Mar. 8, 2023, and the entire contents of which are incorporated herein by reference.

TECHNICAL FIELD

The present invention relates to a working vehicle.

BACKGROUND ART

Conventionally, a working vehicle having a configuration in which a hydraulic pump is driven by performing inverter control on an electric motor, and a travel body and a working unit are hydraulically driven is known (PTL 1: JP Patent No. 6,463,537).

SUMMARY OF INVENTION

Technical Problem

According to the conventional configuration, when a required flow quantity of the pressure oil is increased, for example, in a case where a hydraulic motor and the working unit operate at the same time, the output of the electric motor for driving the hydraulic pump is sometimes insufficient depending on the work amount. A possible countermeasure is to use an electric motor with high maximum torque. However, the use of such an electric motor with high maximum torque presents a problem that the frequency and duration of using the electric motor in an efficient rotation speed range are reduced, leading to the reduction in electric power consumption.

Solution to Problem

The present invention is made in view of the above-described circumstances. Therefore, an object of the invention is to provide a working vehicle in which a plurality of electric motors is capable of following the increase required amount of pressure oil and improving the electric power consumption of the electric motor.

The present invention has been accomplished under the solutions as disclosed below.

The present invention relates to a working vehicle. The working vehicle comprises a control valve unit, a first drive unit supplying hydraulic oil to a primary side of the control valve unit, a travel unit, a lower body provided with the travel unit, an upper body slewably disposed on the lower body, a second drive unit causing the upper body to slew, a cab disposed in the upper body, a plurality of work units and a plurality of traveling hydraulic motors operated by pressure oil from secondary side of the control valve unit, an operation unit operated by an operator, and a controller. The first drive unit includes a first hydraulic pump, a first electric motor that drives the first hydraulic pump, a second hydraulic pump, and a second electric motor that drives the second hydraulic pump, the first hydraulic pump and the second hydraulic pump are respectively a fixed displacement gear pump, and a check valve is disposed on an output side of the first hydraulic pump and an output side of the second hydraulic pump, respectively. The controller performs a control of the first electric motor and the second electric motor to adjust a first rotation speed of the first electric motor and a second rotation speed of the second electric motor such that a total rotation speed of the first rotation speed and the second rotation speed matches a target rotation speed calculated from required amount of pressure oil on the secondary side of the control valve unit.

According to the configuration, the two electric motors for driving the hydraulic pumps can follow the increase in required flow quantity of the pressure oil, and the electric power consumption of the electric motors can be improved.

As an example, the controller performs the control to adjust such that the second rotation speed does not exceed the first rotation speed. This makes it possible to easily increase the frequency and duration of using the first electric motor and the second electric motor in an efficient rotation speed range.

As an example, the working vehicle includes a temperature sensor for detecting a temperature of the hydraulic oil. The controller performs the control to adjust such that the first rotation speed and the second rotation speed are limited according to a reference, when the temperature is lower than the reference. This prevents cavitation and unusual sound due to increased viscosity of hydraulic oil, resulting in the improvement in the electric power consumption.

As an example, the second drive unit includes a slewing electric motor with a speed reducer. The controller performs the control to adjust such that the total value is matched to the target rotation speed in a case where the second drive unit is not operated. The controller performs the control to adjust such that the total value is reduced to be lower than the target rotation speed and horsepower is reduced in a case where the second drive unit is operated. This can increase the operating time of the working unit for a case where the second drive unit is operated.

As an example, the second drive unit includes a slewing electric motor with a speed reducer, and the cab is provided with an air conditioner with an electric motor. The controller performs the control to adjust such that the total value is matched to the target rotation speed in a case where both the second drive unit and the air conditioner are not operated. The controller performs the control to adjust such that the total value is reduced to be lower than the target rotation speed and horsepower is reduced in a case where any one or both the second drive unit and the air conditioner is operated. As an example, the operating unit switches between a normal mode and a horsepower-reduced mode. Accordingly, when the operating unit is placed in the normal mode, the work amount of the working unit per unit time can be increased without reduction of the horsepower. It is thus possible to select the increase in operating time or the increase in work amount per unit time according to the work site situations.

Advantageous Effects of Invention

According to the invention, the working vehicle can be achieved in which backflow to the hydraulic pumps is prevented, the two electric motors for driving the hydraulic pumps can follow the increase in required flow quantity of the pressure oil, and the electric power consumption of the electric motors can be improved compared to the conventional configurations.

DESCRIPTION OF EMBODIMENTS

Figure 1:
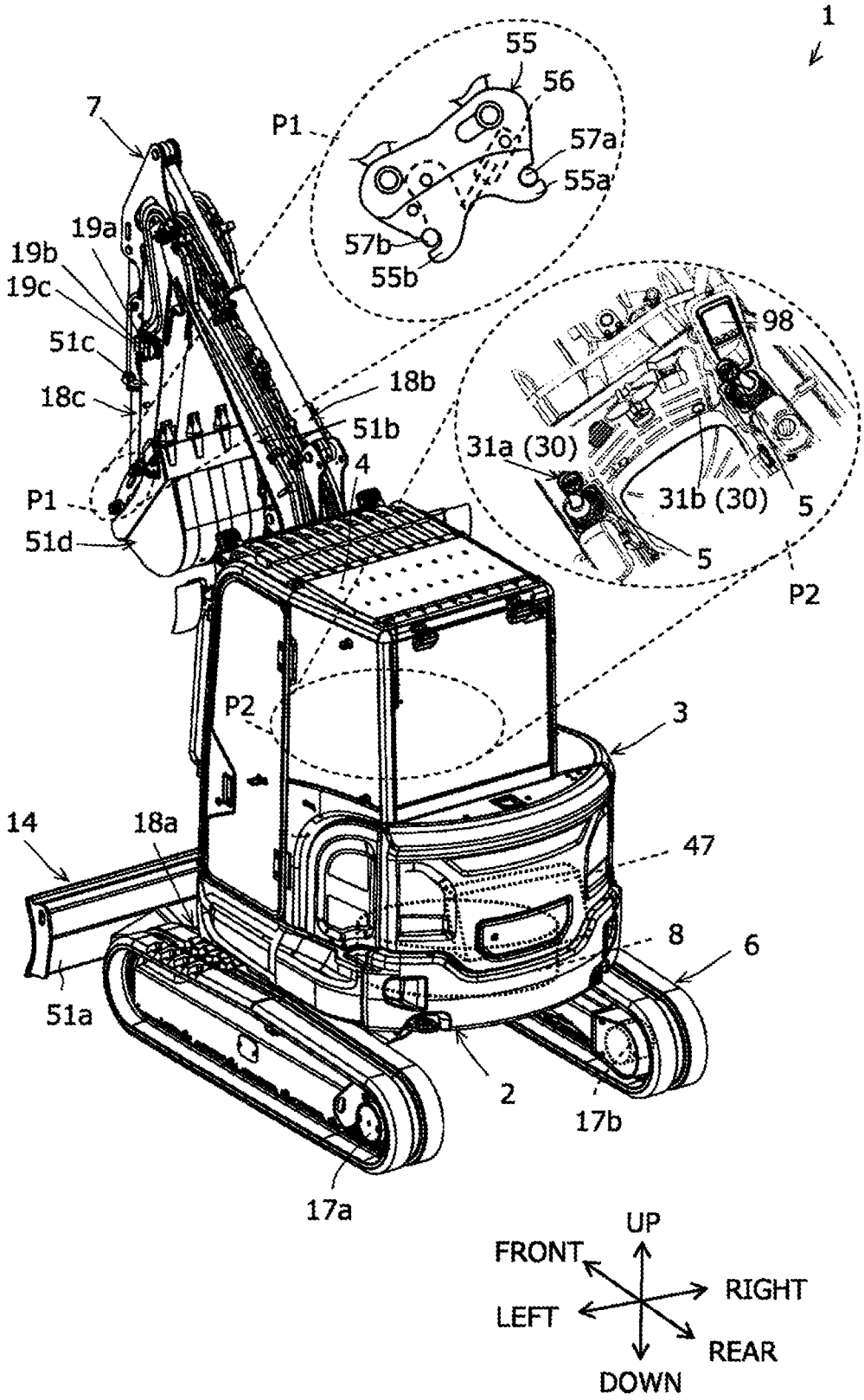
FIG. 1 is a schematic perspective view showing an example of a working vehicle according to an embodiment.

Hereinafter, an embodiment of the invention will be explained in detail with reference to the drawings. FIG. 1 is a schematic view showing an example of a working vehicle 1 according to the embodiment, and is a perspective view from the upper left rear. As an example of the working vehicle 1 of the embodiment, a hydraulic excavator is described herein. As a configuration other than the above, the working vehicle 1 may be a track loader or a tracked dumper. Incidentally, for the purpose of illustration, up and down, left and right, front and rear directions may be represented by arrows in the diagrams. Further, in the diagrams for use in describing the embodiment, members having the same functions are assigned the respective same reference characters, and the repetitive description thereof may be omitted.

The working vehicle 1 includes an on-board charger that supplies electric power to a plurality of electric motors and so on and a display unit 98 that is configured to display information on operation of a drive unit, information on remaining battery capacity, and other known vehicle information. Incidentally, devices for use in travel motion and work in the working vehicle 1 are common to those in a known working vehicle, and the detailed description thereof is omitted.

As shown in FIG. 1, the working vehicle 1 includes a lower body 2 that is configured to travel and an upper body 3 that is provided on the lower body 2 and configured to slew. The lower body 2 includes a travel unit 6, and the travel unit 6 has a left and right pair of crawlers (track), as an example. The upper body 3 includes a cab 4, and the cab 4 has, in the front, operating units 5 for an operator riding on the vehicle to operate driving and work operations. A part enclosed by a broken line P2 in the drawing shows a schematic configuration of the operating units 5. The travel unit 6 includes a hydraulic motor 17*a* for travelling in a left travel body and a hydraulic motor 17*b* for travelling in a right travel body. As a configuration other than the above, the travel unit 6 may be a travel unit having tires.

The working vehicle 1 includes a slewing unit 8 operated by a second drive unit 16. As an example, the second drive unit 16 has an electric motor 16*a* to which a speed reducer 16*c* is assembled and has a configuration in which a pinion gear of the speed reducer 16*c* is engaged with a slewing bearing of the lower body 2 (not shown). As a configuration other than the above, a slewing unit provided with a hydraulic motor can be used.

The working vehicle 1 is provided with a plurality of working units including a working unit 7 and a working unit 14, and the plurality of working units is configured to be operated hydraulically (by hydraulic oil at a predetermined pressure). The working unit 14 includes a blade 51*a*, for example. The blade 51*a* is attached to the lower body 2 as to swing in the up-down direction and in the up-down direction including the front and rear components.

The working unit 7 includes, as an example, a boom 51*b*, an arm 51*c*, and an attachment 51*d* such as a bucket. The attachment 51*d* is, however, not limited to the bucket and a known attachment can be used. The boom 51*b* is attached to the upper body 3 as to swing in the up-down direction and in the up-down direction including the front and rear components. In the embodiment, a boom bracket is provided (not shown) between the upper body 3 and the boom 51*b*. The boom bracket enables the boom 51*b* to swing in the left-right direction and in the left-right direction including the front and rear components with respect to the upper body 3. Incidentally, the boom bracket is sometimes omitted. The arm 51*c* is attached to the boom 51*b* as to swing in the up-down direction and in the up-down direction including the front and rear components. The attachment 51*d* (bucket) is attached to the arm 51*c* as to swing in the up-down direction and in the up-down direction including the front and rear components. In the embodiment, the attachment 51*d* is caught and locked by a quick hitch 55 attached to the arm 51*c*. A part enclosed by a broken line P1 in the drawing shows a schematic configuration of the quick hitch 55.

As an example, the blade 51*a* is configured to swing, by a hydraulic cylinder 18*a* for the blade, in the up-down direction with respect to the lower body 2. As an example, the arm 51*c* is configured to swing, by a hydraulic cylinder 18*b* for the arm, in the up-down direction with respect to the boom 51*b*. As an example, the attachment 51*d* (bucket) is configured to swing, by a hydraulic cylinder 18*c* for the bucket, in the up-down direction with respect to the arm 51*c*. As an example, the boom 51*b* is configured to swing, by a boom cylinder, in the up-down direction with respect to the upper body 3 (not shown). As an example, the boom 51*b* is configured to swing, by a swing cylinder, in the left-right direction with respect to the upper body 3 (not shown).

As an example, the quick hitch 55 includes a fixed claw 55*a*, a movable claw 55*b*, and a quick hitch cylinder 56 (quick hitch actuator) for pivoting the movable claw 55*b*. In order to lock the quick hitch 55, the operator operates the operating unit 5 to attach the fixed claw 55*a* to a first pin 57*a* provided in the attachment 51*d* (bucket), and then, to attach the movable claw 55*b* to a second pin 57*b* provided in the attachment 51*d* (bucket). Then, the quick hitch cylinder 56 is extended to lock the attachment 51*d*. In order to unlock the quick hitch 55, the operator operates the operating unit 5 to retract the quick hitch cylinder 56, and the attachment 51*d* is unlocked.

The plurality of operating units 5 (operating levers) operated by the operator are provided in the cab 4. As an example, a trigger switch 30 includes a first button 31*a*

(hand button) in the left operating unit 5 and a second button 31*b* (foot button) provided on the floor of the cab 4. In a case where the operator presses both the first button 31*a* and the second button 31*b*, a trigger signal is sent to a controller 9, and control is carried out to unlock the quick hitch 55. In addition to the configuration described above, as an example, the working vehicle 1 includes a plurality of switches such as a key switch and a push switch for both starting and stopping the working vehicle 1 (not shown).

As an example, a service actuator such as a breaker is connected to a port 19*a* for the first service actuator. As an example, a service actuator such as a swing actuator for rotating the quick hitch 55 around the longitudinal axis is connected to a port 19*b* for the second service actuator. The quick hitch cylinder 56 (quick hitch actuator) is connected to a port 19*c* for the third service actuator (port for the quick hitch actuator). Incidentally, the quick hitch 55 is an optional member and a configuration without the quick hitch 55 is also possible.

Figure 2:
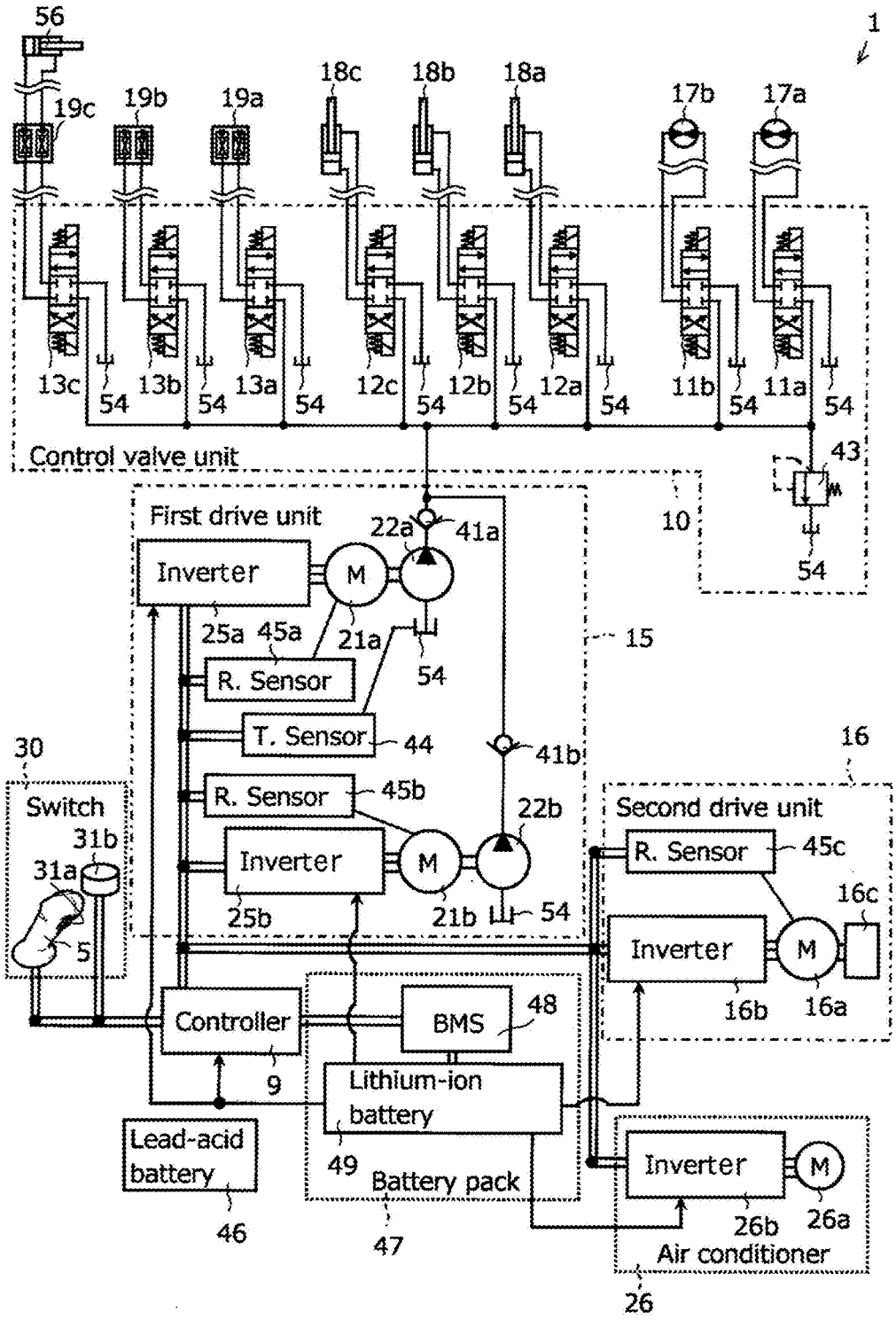
FIG. 2 is a schematic circuit diagram showing an example of a drive control system in the working vehicle shown in FIG. 1.

FIG. 2 is a schematic circuit diagram showing an example of a drive control system in the working vehicle 1. The working vehicle 1 includes a first drive unit 15 for supplying hydraulic oil at a predetermined pressure to the hydraulic motors 17*a*, 17*b* for travelling, the oil pressure cylinders 18*a*, 18*b*, 18*c*, and the ports 19*a*, 19*b*, 19*c* for the service actuators. The working vehicle 1 also includes the second drive unit 16 for operating the electric swing unit 8. The ports 19*a*, 19*b*, 19*c* for the service actuators are connection ports for hydraulically operating the individual attachments optionally attached. Incidentally, in the circuit diagram of FIG. 2, some notations except for the main parts are omitted.

The working vehicle 1 includes a battery pack 47. The battery pack 47 has a battery management system 48 and a lithium-ion rechargeable battery 49. The lithium-ion rechargeable battery 49 is formed by combining many cells, and power supply voltage of the lithium-ion rechargeable battery 49 is 70 to 600 [V], for example. The battery pack 47 is removable attached to the working vehicle 1. The battery pack 47 contains various sensors therein, and a wiring diagram thereof is omitted. As an example, the working vehicle 1 has a lead-acid battery 46 for supplying electric power to the battery management system 48 at the time of starting of the working vehicle 1.

The first drive unit 15 includes a first hydraulic pump 22*a* that draws in hydraulic oil stored in a hydraulic oil tank 54 to discharge the hydraulic oil, a first electric motor 21*a* for driving the first hydraulic pump 22*a*, and a first inverter 25*a* for supplying electric power to the first electric motor 21*a* according to a command from the controller 9. Further, the first drive unit 15 includes a second hydraulic pump 22*b* that draws in hydraulic oil stored in the hydraulic oil tank 54 to discharge the hydraulic oil, a second electric motor 21*b* for driving the second hydraulic pump 22*b*, and a second inverter 25*b* for supplying electric power to the second electric motor 21*b* according to the command. The first drive unit 15 is configured to combine a first output unit of the first hydraulic pump 22*a* with a second output unit of the second hydraulic pump 22*b* to feed the hydraulic oil to a primary side of a control valve unit 10.

The control valve unit 10 has a configuration in which primary sides of a plurality of control valves are connected in parallel. In the example of FIG. 2, primary sides of control valves 11*a*, 11*b* for the hydraulic motors, of control valves 12*a*, 12*b*, 12*c* for the oil pressure cylinders, and of control valves 13*a*, 13*b*, 13*c* for the service actuators are connected in parallel. The number of control valves constituting the control valve unit 10 sometimes increases or decreases. Further, the control valve unit 10 includes a relief valve 43, and a primary side of the relief valve 43 is connected in parallel to the primary side of each of the control valves. A secondary side of the relief valve 43 serves as a return passage for the secondary side, and hydraulic oil exceeding a set pressure is returned to the hydraulic oil tank 54.

The first drive unit 15 includes a first check valve 41*a* and a second check valve 41*b*. In the embodiment, a configuration is provided in which a primary side of the first check valve 41*a* is connected to the output side of the first hydraulic pump 22*a*, a primary side of the second check valve 41*b* is connected to the output side of the second hydraulic pump 22*b*, and a secondary side of the first check valve 41*a* is combined with a secondary side of the second check valve 41*b* to be connected to the primary side of the control valve unit 10. According to the embodiment, backflow of the pressure oil from the first hydraulic pump 22*a* to the second hydraulic pump 22*b* can be prevented, and backflow of the pressure oil from the second hydraulic pump 22*b* to the first hydraulic pump 22*a* can be also prevented.

The first hydraulic pump 22*a* and the second hydraulic pump 22*b* are both fixed displacement gear pumps. The first electric motor 21*a* and the second electric motor 21*b* are both synchronous motors and are both magnets-embedded motors (IPM motors). According to the above configuration, it is possible to quickly follow the increase in required flow quantity of the pressure oil. As an example, a rated output of the first hydraulic pump 22*a* is the same as a rated output of the second hydraulic pump 22*b*. As an example, maximum torque of the first electric motor 21*a* is the same as maximum torque of the second electric motor 21*b*.

The first drive unit 15 includes a rotation speed sensor 45*a* for detecting a rotation speed of the first electric motor 21*a*, and a rotation speed sensor 45*b* for detecting a rotation speed of the second electric motor 21*b*. The first drive unit 15 includes a temperature sensor 44 for detecting a temperature of the hydraulic oil in the hydraulic oil tank 54. The second drive unit 16 includes the electric motor 16*a* to which the speed reducer 16*c* is assembled and an inverter 16*b* that supplies electric power to the electric motor 16*a* according to the command. The second drive unit 16 includes a rotation speed sensor 45*c* for detecting a rotation speed of the electric motor 16*a*.

The cab 4 is provided with an air conditioner 26. The air conditioner 26 includes an electric motor 26*a* and an inverter 26*b* that supplies electric power to the electric motor 26*a* according to a command from the controller 9.

The operator operates the operating units 5 implemented by an operating lever, a joystick, or to operate the travel unit 6, the working unit 7, the swing unit 8, the working unit 14, and so on. In response to the operating unit 5 operated, an operation signal is output to the controller 9.

Figure 3:
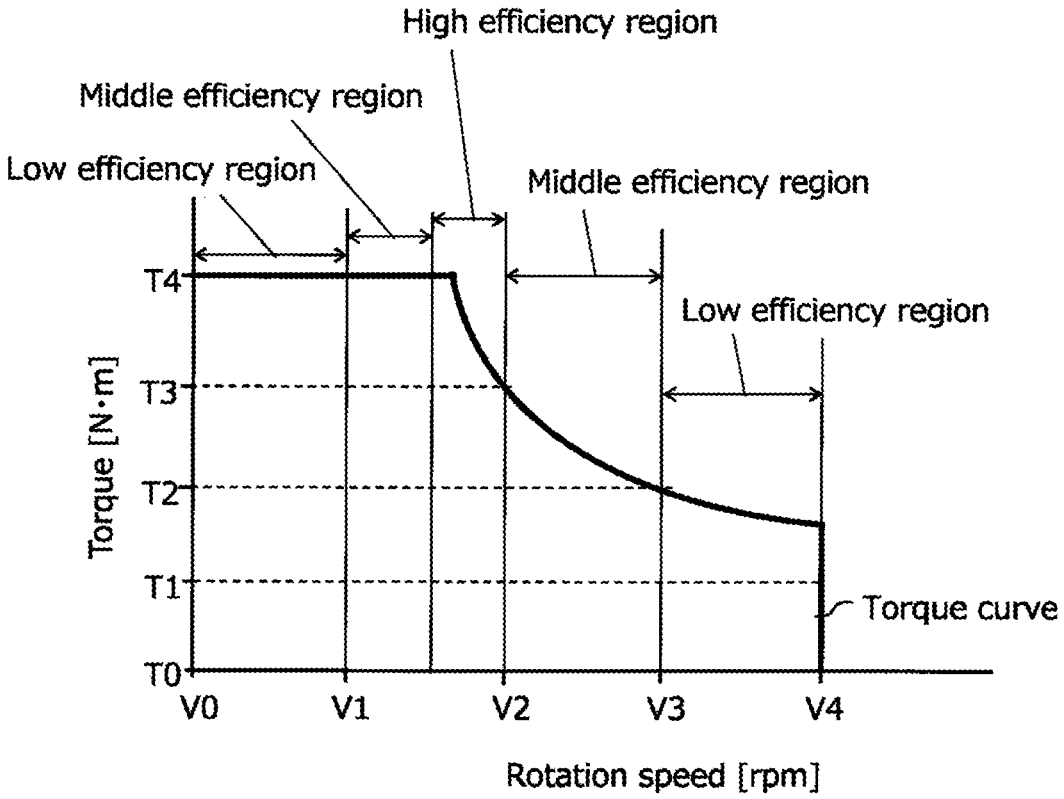
FIG. 3 is a schematic graph showing a rotation speed-torque curve for a first electric motor and a second electric motor shown in FIG. 2.

FIG. 3 is a schematic graph showing a rotation speed-torque curve for the first electric motor 21*a* and the second electric motor 21*b*. In FIG. 3, a minimum rotation speed V0 corresponds to an idling state. In FIG. 3, minimum torque is developed at a maximum rotation speed V4.

In the working vehicle 1, the first electric motor 21*a* and the second electric motor 21*b* are required to develop necessary torque over a wide speed range. The region having a rotation speed of V1 or less is a high-torque region, and a quantity of the hydraulic oil discharged from the first hydraulic pump 22*a* and the second hydraulic pump 22*b* is lower than the required flow quantity of the pressure oil. Then, resulting in low efficiency. Further, the region having a rotation speed of V3 or more is a low-torque region, and a quantity of the hydraulic oil discharged from the first hydraulic pump 22*a* and the second hydraulic pump 22*b* is higher than the required flow quantity of the pressure oil. Then, resulting in low efficiency. A middle-efficiency region or a high-efficiency region in the graph is used positively, and thereby, further improvement in the electric power consumption is expected.

Figure 4:
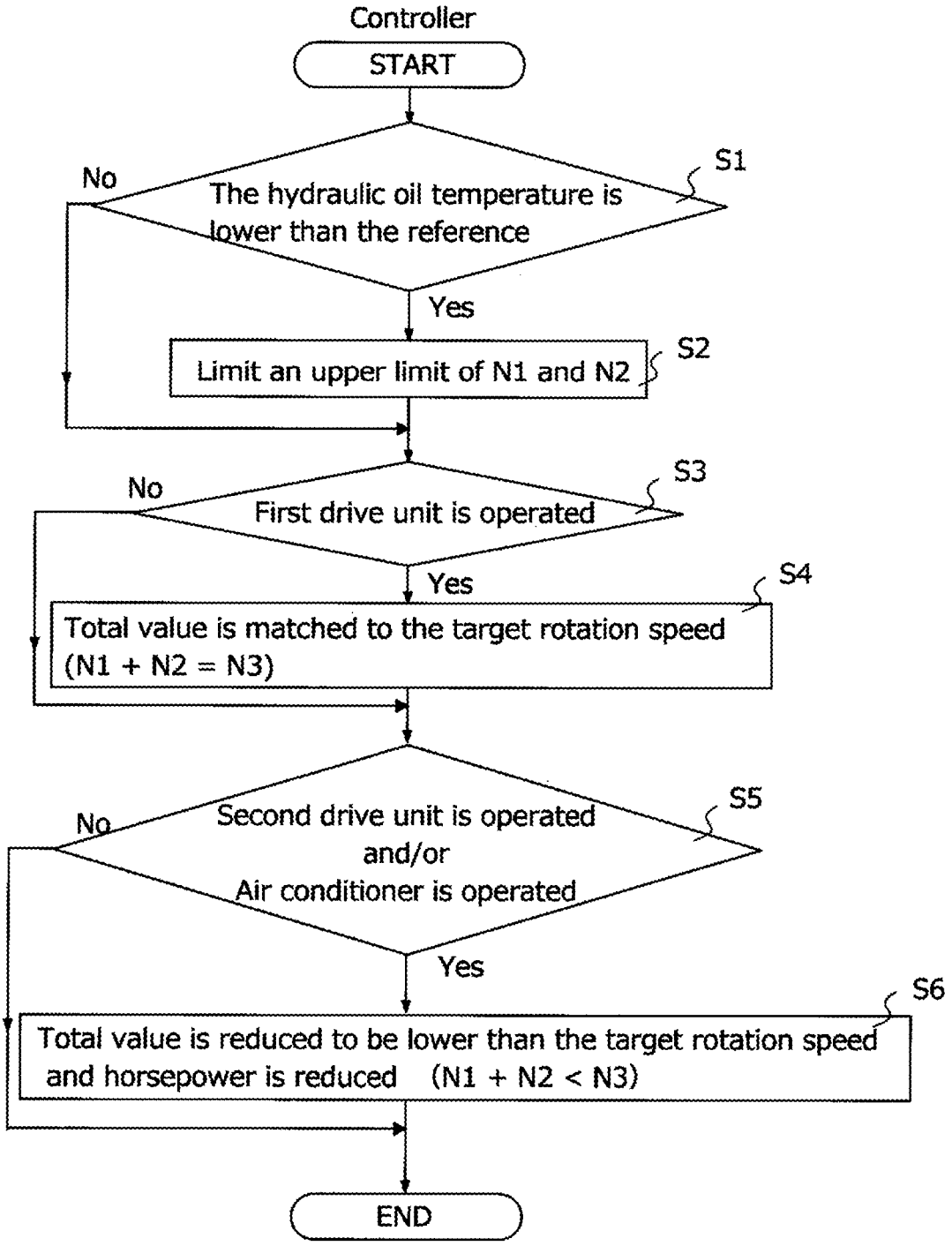
FIG. 4 is a schematic flowchart showing an operation procedure for controlling a rotation speed of a controller shown in FIG. 2.

FIG. 4 is a schematic flowchart showing an operation procedure for controlling a rotation speed of the first electric motor 21*a* and the second electric motor 21*b* in the controller 9 according to the embodiment. Next, the operation procedure for the rotation speed control by the controller 9 of the working vehicle 1 is described.

In step S1 of FIG. 4, the controller 9 determines whether a hydraulic oil temperature is lower than a reference value (set temperature). When the controller 9 judges that the hydraulic oil temperature detected by the temperature sensor 44 is lower than the reference value, then proceeds to step S2. On the other hand, When the controller 9 judges that the hydraulic oil temperature detected by the temperature sensor 44 is equal to or higher than the reference value, then proceeds to step S3.

In step S2 of FIG. 4, the controller 9 limits an upper limit of a first rotation speed N1 of the first electric motor 21*a* and an upper limit of a second rotation speed N2 of the second electric motor 21*b*. As an example, the controller 9 limits the upper limits to a rotation speed V2 or less. As an example, the controller 9 limits the upper limits to the rotation speed V1 or less. After step S2, proceeds to step S3.

In step S3 of FIG. 4, the controller 9 determines whether the first drive unit 15 is operated. When the controller 9 determines that the first drive unit 15 is operated, then proceeds to step S4. On the other hand, When the controller 9 determines that the first drive unit 15 is not operated, then proceeds to step S5.

In step S4 of FIG. 4, the controller 9 calculates a required flow quantity of the pressure oil necessary on a secondary side of the control valve unit 10, and performs rotation speed control such that a total value of the first rotation speed N1 of the first electric motor 21*a* and the second rotation speed N2 of the second electric motor 21*b* is made equal to a target rotation speed N3 that is calculated from the required flow quantity of the pressure oil (N1+N2=N3). Specific examples of the rotation speed control are described later. After step S4, proceeds to step S5.

In step S5 of FIG. 4, the controller 9 determines whether the slewing electric motor 16*a* is operated, or determines whether the electric motor 26*a* for the air conditioner is operated. If either the slewing electric motor 16*a* or the electric motor 26*a* for the air conditioner is operated, or if both the slewing electric motor 16*a* and the electric motor 26*a* for the air conditioner are operated, then proceeds to step S6. On the other hand, if neither the slewing electric motor 16*a* nor the electric motor 26*a* for the air conditioner is operated, then the controller 9 finishes the operation for the rotation speed control.

In step S6 of FIG. 4, if either the slewing electric motor 16*a* or the electric motor 26*a* for the air conditioner is operated, or if both the slewing electric motor 16*a* and the electric motor 26*a* for the air conditioner are operated, then the controller 9 reduces the total value to be lower than the target rotation speed N3 and reduces the horsepower (N1+N2<N3). Then, the controller 9 finishes the operation for the rotation speed control.

The description goes on to a first example, a second example, and a third example of the rotation speed control.

The rotation speed control in the embodiments is control using a method for gradually increasing any one or both first rotation speed N1 of the first electric motor 21*a* and the second rotation speed N2 of the second electric motor 21*b*, and is to improve the electric power consumption by causing the motors to perform operation according to the required flow quantity of the pressure oil.

First Example

Figure 5A:
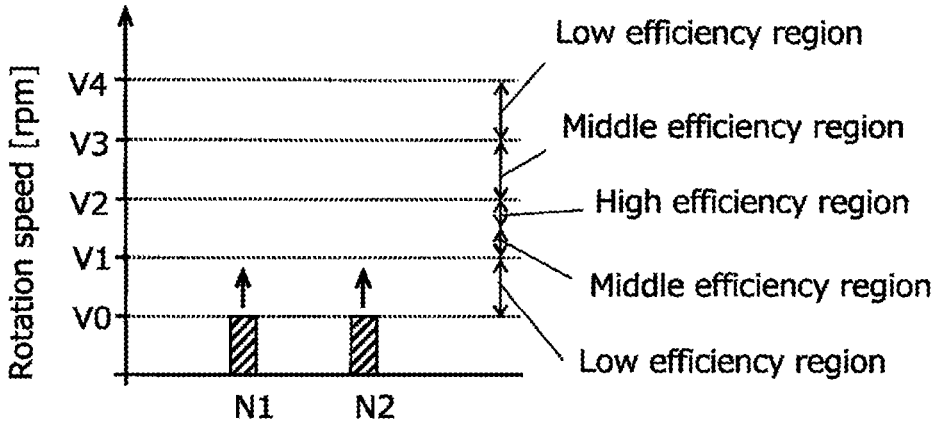
FIG. 5A is a schematic graph showing an initial state of rotation speed control on the first electric motor and the second electric motor in a first example.
Figure 5B:
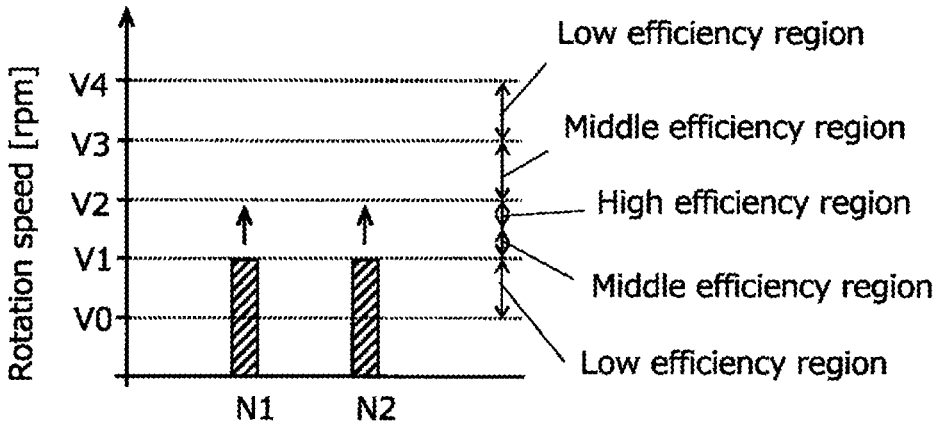
FIG. 5B is a schematic graph showing a state of transition from FIG. 5A.
Figure 5C:
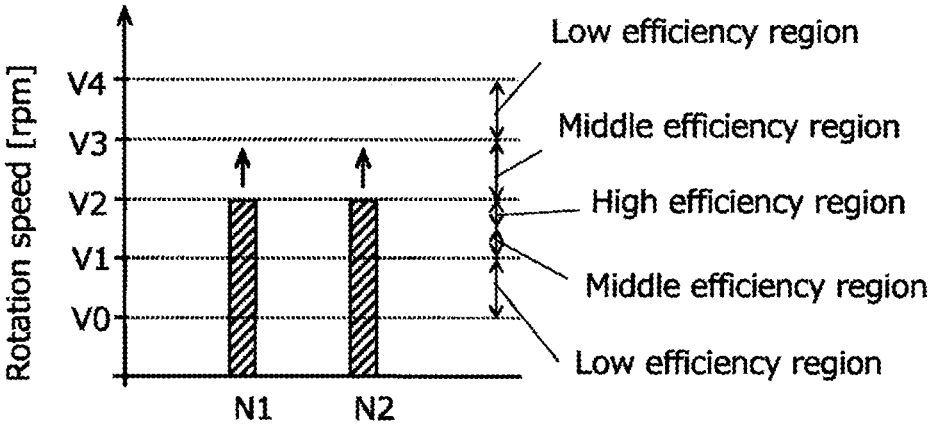
FIG. 5C is a schematic graph showing a state of transition from FIG. 5B.

FIG. 5A is a schematic graph showing an initial state of rotation speed control on the first electric motor 21*a* and the second electric motor 21*b* in the first example. FIG. 5B is a schematic graph showing a state of transition from FIG. 5A. FIG. 5C is a schematic graph showing a state of transition from FIG. 5B.

FIGS. 5A to 5C show a method in which the first electric motor 21*a* and the second electric motor 21*b* gradually increase the first rotation speed N1 and the second rotation speed N2 with the minimum rotation speed V0 set as the starting point and the first rotation speed N1 of the first electric motor 21*a* and the second rotation speed N2 of the second electric motor 21*b* having a relationship of N1=N2, and the method is to cause the motors to operate according to the required flow quantity of the pressure oil. The first example is the simplest control method.

Second Example

Figure 6A:
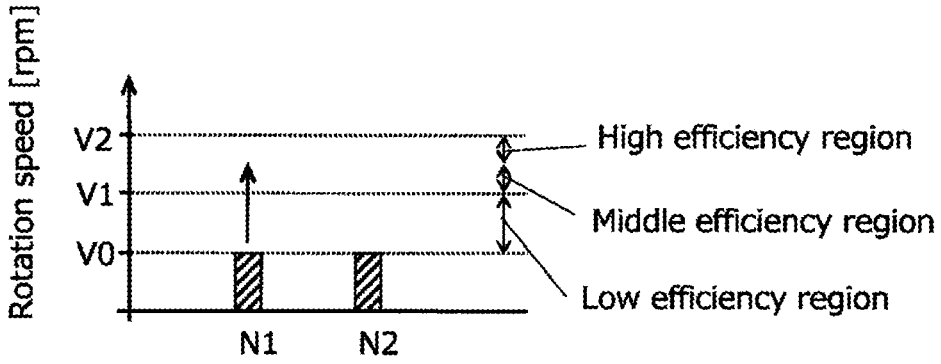
FIG. 6A is a schematic graph showing an initial state of rotation speed control on the first electric motor and the second electric motor in a second example.
Figure 6B:
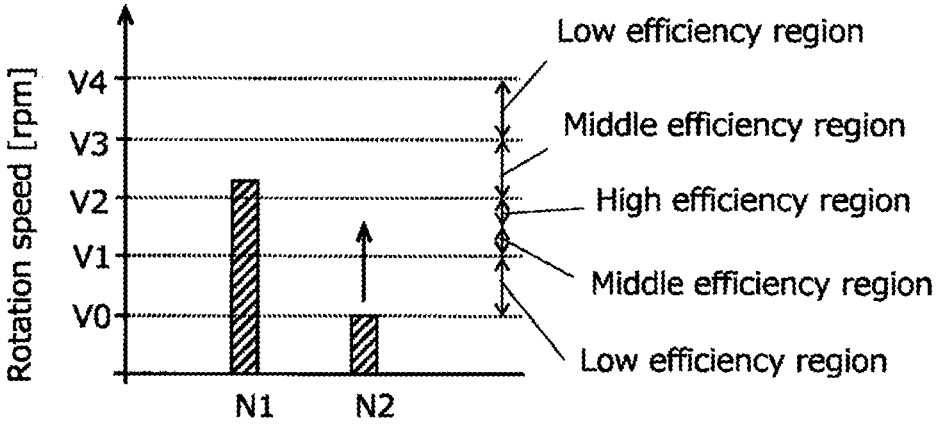
FIG. 6B is a schematic graph showing a state of transition from FIG. 6A.
Figure 6C:
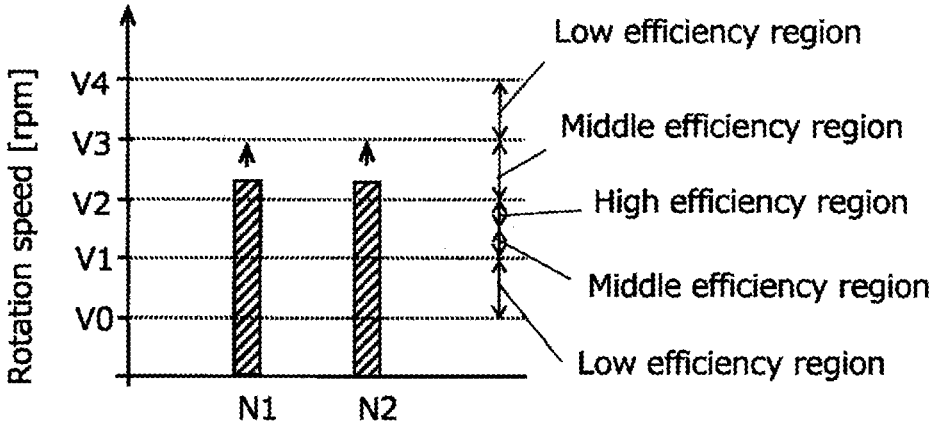
FIG. 6C is a schematic graph showing a state of transition from FIG. 6B.

FIG. 6A is a schematic graph showing an initial state of rotation speed control on the first electric motor 21*a* and the second electric motor 21*b* in the second example. FIG. 6B is a schematic graph showing a state of transition from FIG. 6A. FIG. 6C is a schematic graph showing a state of transition from FIG. 6B.

As shown in FIGS. 6A to 6B, the first electric motor 21*a* gradually increases the first rotation speed N1 with the minimum rotation speed V0 set as the starting point, and is made to operate according to the required flow quantity of the pressure oil. First, only the first electric motor 21*a* is operated to reach the middle-efficiency region. Currently, the second electric motor 21*b* maintains the minimum rotation speed V0.

Next, as shown in FIGS. 6B to 6C, in a case where the required flow quantity of the pressure oil is further increased and the first electric motor 21*a* can no longer cope with the required flow quantity of the pressure oil in the middle-efficiency region, the second electric motor 21*b* gradually increases the second rotation speed N2 and is made to operate according to the shortage of the required flow quantity of the pressure oil. Following the first electric motor 21*a*, the second electric motor 21*b* is operated to reach the middle-efficiency region.

Then, as shown in FIG. 6C, in a case where the required flow quantity of the pressure oil is further increased, the first rotation speed N1 of the first electric motor 21*a* is made equal to the second rotation speed N2 of the second electric motor 21*b* (N1=N2), the first rotation speed N1 and the second rotation speed N2 are gradually increased, and the first electric motor 21*a* and the second rotation speed N2 are made to operate according to the required flow quantity of the pressure oil. As compared with the first example, the method according to the second example is a control method in which the frequency and duration of using the first electric motor 21*a* and the second electric motor 21*b* in a highly efficient region is increased.

Third Example

Figure 7A:
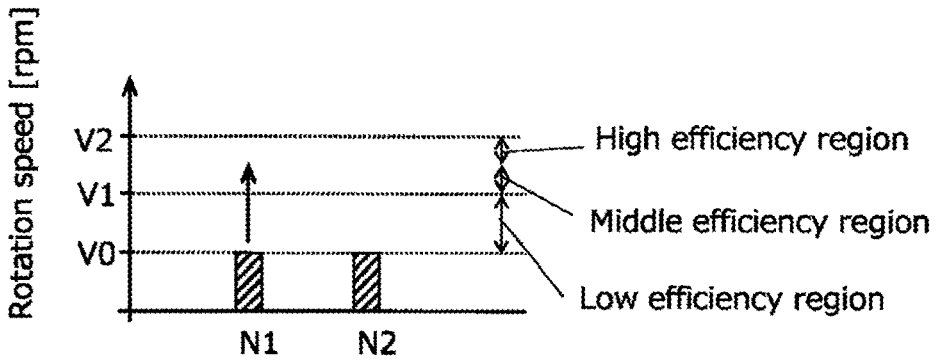
FIG. 7A is a schematic graph showing an initial state of rotation speed control on the first electric motor and the second electric motor in a third example.
Figure 7B:
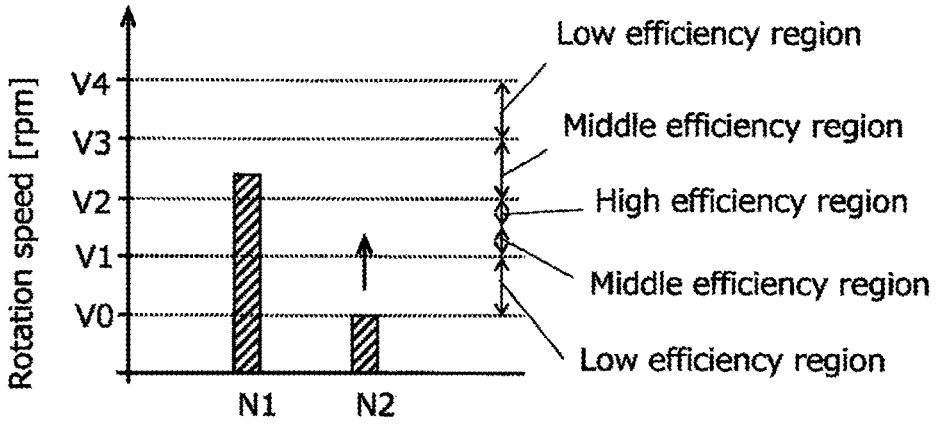
FIG. 7B is a schematic graph showing a state of transition from FIG. 7A.
Figure 7C:
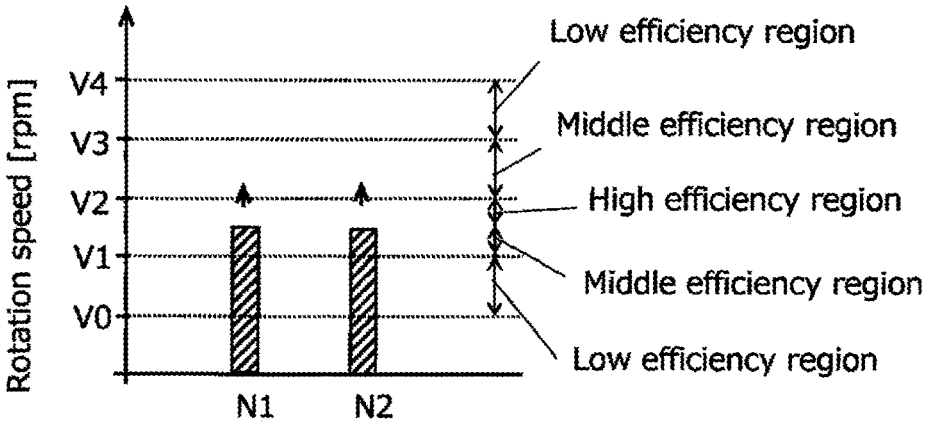
FIG. 7C is a schematic graph showing a state of transition from FIG. 7B.
Figure 7D:
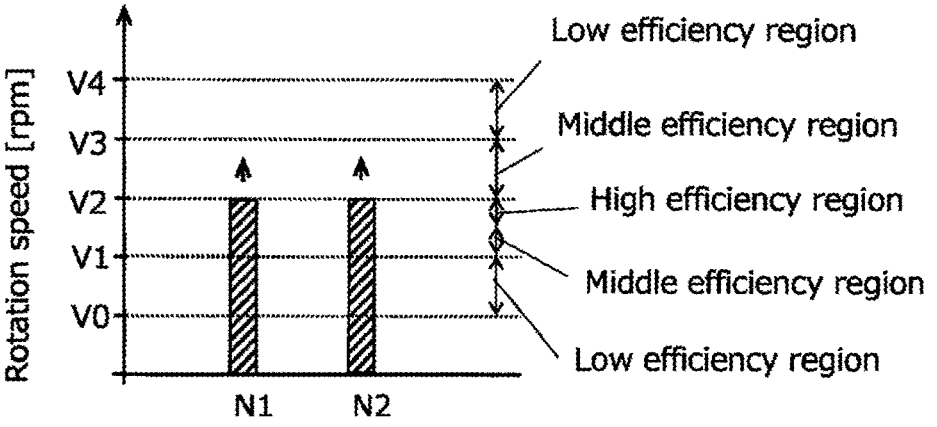
FIG. 7D is a schematic graph showing a state of transition from FIG. 7C.

FIG. 7A is a schematic graph showing an initial state of the rotation speed control on the first electric motor 21*a* and the second electric motor 21*b* in the third example. FIG. 7B is a schematic graph showing a state of transition from FIG. 7A. FIG. 7C is a schematic graph showing a state of transition from FIG. 7B. FIG. 7D is a schematic graph showing a state of transition from FIG. 7C.

As shown in FIGS. 7A to 7B, the first electric motor 21*a* gradually increases the first rotation speed N1 with the minimum rotation speed V0 set as the starting point, and is made to operate according to the required flow quantity of the pressure oil. First, only the first electric motor 21*a* is operated to reach the middle-efficiency region. Currently, the second electric motor 21*b* maintains the minimum rotation speed V0.

Next, as shown in FIGS. 7B to 7C, in a case where the required flow quantity of the pressure oil is further increased and the first electric motor 21*a* can no longer cope with the required flow quantity of the pressure oil in the middle-efficiency region, the second electric motor 21*b* gradually increases the second rotation speed N2 and is made to operate according to the shortage of the required flow quantity of the pressure oil. Currently, the second electric motor 21*b* is operated to reach the beginning of the high-efficiency region. In a case where the second electric motor 21*b* reaches a state of the beginning of the high-efficiency region, the first electric motor 21*a* is also set to the state of the beginning of the high-efficiency region.

Then, as shown in FIGS. 7C to 7D, in a case where the required flow quantity of the pressure oil is further increased, the first rotation speed N1 of the first electric motor 21*a* is made equal to the second rotation speed N2 of the second electric motor 21*b* (N1=N2), the first rotation speed N1 and the second rotation speed N2 are gradually increased, and the first electric motor 21*a* and the second electric motor 21*b* are made to operate according to the required flow quantity of the pressure oil. As compared with the first and second examples, the method according to the third example is a control method in which the frequency and duration of using the first electric motor 21*a* and the second electric motor 21*b* in a highly efficient region is the largest.

According to the embodiments described above, the controller 9 controls the rotation speed of the first electric motor 21*a* for driving the first hydraulic pump 22*a* and the rotation speed of the second electric motor 21*b* for driving the second hydraulic pump 22*b*. As a result, it is possible to achieve the working vehicle 1 that can follow the increase in required flow quantity of the pressure oil and can improve the electric power consumption of the first electric motor 21*a* and the second electric motor 21*b*.

The drive source of the working vehicle 1 is not limited to the above configuration, and another configuration is possible in which an engine is used along with the electric motors. Further, the battery of the working vehicle 1 is not limited to the above configuration and a known secondary battery such as a nickel-metal hydride battery can be used. In this way, the working vehicle 1 is sometimes modified appropriately according to the specifications and so on.

What is claimed is:

1. A working vehicle, comprising:

a control valve unit;

a first drive unit supplying hydraulic oil to a primary side of the control valve unit;

a travel unit;

a lower body provided with the travel unit;

an upper body slewably disposed on the lower body;

a second drive unit causing the upper body to slew;

a cab disposed in the upper body;

a plurality of work units and a plurality of traveling hydraulic motors operated by pressure oil from a secondary side of the control valve unit;

an operation unit operated by an operator; and a controller, wherein the first drive unit includes a first hydraulic pump, a first electric motor that drives the first hydraulic pump, a first rotation speed sensor that detects a first rotation speed of the first electric motor, a second hydraulic pump, a second electric motor that drives the second hydraulic pump, and a second rotation speed sensor that detects a second rotation speed of the second electric motor, the first hydraulic pump and the second hydraulic pump are respectively a fixed displacement gear pump, and a check valve is disposed on an output side of the first hydraulic pump and an output side of the second hydraulic pump, respectively, the controller performs control of a total rotation speed obtained by combining the first rotation speed detected by the first rotation speed sensor and the second rotation speed detected by the second rotation speed sensor to match a target rotation speed calculated from a required flow quantity of the pressure oil necessary at the secondary side of the control valve unit, and the controller performs, when the total rotation speed obtained by combining the first rotation speed and the second rotation speed is to match the target rotation speed calculated from the required flow quantity of the pressure oil, the control of the total rotation speed to match the target rotation speed by gradually increasing the first rotation speed of the first electric motor with a minimum rotation speed set as a starting point, in a case where the first electric motor can no longer cope with the required flow quantity of the pressure oil, gradually increasing the second rotation speed, and in a case where the required flow quantity of the pressure oil is further increased, making the first rotation speed equal to the second rotation speed and gradually increasing them both.

2. The working vehicle according to claim 1, wherein the controller performs the control to adjust such that the second rotation speed does not exceed the first rotation speed.

3. The working vehicle according to claim 2, wherein the second drive unit includes a slewing electric motor with a speed reducer, and wherein the controller performs the control to adjust such that the total rotation speed is matched to the target rotation speed in a case where the second drive unit is not operated, and wherein the controller performs the control to adjust such that the total rotation speed is reduced to be lower than the target rotation speed and horsepower is reduced in a case where the second drive unit is operated.

4. The working vehicle according to claim 2, wherein the second drive unit includes a slewing electric motor with a speed reducer, and the cab is provided with an air conditioner with an electric motor, and wherein the controller performs the control to adjust such that the total rotation speed is matched to the target rotation speed in a case where both the second drive unit and the air conditioner are not operated, and wherein the controller performs the control to adjust such that the total rotation speed is reduced to be lower than the target rotation speed and horsepower is reduced in a case where any one or both the second drive unit and the air conditioner is operated.

5. The working vehicle according to claim 1, further comprising:

a temperature sensor for detecting a temperature of the hydraulic oil, wherein the controller performs the control to adjust such that the first rotation speed and the second rotation speed are limited according to a reference, when the temperature is lower than the reference.

6. The working vehicle according to claim 5, wherein the second drive unit includes a slewing electric motor with a speed reducer, and wherein the controller performs the control to adjust such that the total rotation speed is matched to the target rotation speed in a case where the second drive unit is not operated, and wherein the controller performs the control to adjust such that the total rotation speed is reduced to be lower than the target rotation speed and horsepower is reduced in a case where the second drive unit is operated.

7. The working vehicle according to claim 5, wherein the second drive unit includes a slewing electric motor with a speed reducer, and the cab is provided with an air conditioner with an electric motor, and wherein the controller performs the control to adjust such that the total value rotation speed is matched to the target rotation speed in a case where both the second drive unit and the air conditioner are not operated, and wherein the controller performs the control to adjust such that the total rotation speed is reduced to be lower than the target rotation speed and horsepower is reduced in a case where any one or both the second drive unit and the air conditioner is operated.

8. The working vehicle according to claim 1, wherein the second drive unit includes a slewing electric motor with a speed reducer, and wherein the controller performs the control to adjust such that the total rotation speed is matched to the target rotation speed in a case where the second drive unit is not operated, and wherein the controller performs the control to adjust such that the total rotation speed is reduced to be lower than the target rotation speed and horsepower is reduced in a case where the second drive unit is operated.

9. The working vehicle according to claim 1, wherein the second drive unit includes a slewing electric motor with a speed reducer, and the cab is provided with an air conditioner with an electric motor, and wherein the controller performs the control to adjust such that the total rotation speed is matched to the target rotation speed in a case where both the second drive unit and the air conditioner are not operated, and wherein the controller performs the control to adjust such that the total rotation speed is reduced to be lower than the target rotation speed and horsepower is reduced in a case where any one or both the second drive unit and the air conditioner is operated.

* * * * *